US007236141B2

(12) United States Patent
Huang

(10) Patent No.: US 7,236,141 B2
(45) Date of Patent: Jun. 26, 2007

(54) ANTENNA SYSTEM AND A METHOD FOR FABRICATING THE SAME

(75) Inventor: Tzung-Fang Huang, Chiayi Hsien (TW)

(73) Assignee: Benq Corporation, Taoyuan (TW)

( * ) Notice: Subject to any disclaimer, the term of this patent is extended or adjusted under 35 U.S.C. 154(b) by 75 days.

(21) Appl. No.: 11/262,426

(22) Filed: Oct. 28, 2005

(65) Prior Publication Data

US 2006/0092092 A1 May 4, 2006

(30) Foreign Application Priority Data

Oct. 29, 2004 (TW) ..... 93133141 A

(51) Int. Cl.
*H01Q 1/36* (2006.01)

(52) U.S. Cl. ..... 343/895; 343/700 MS

(58) Field of Classification Search ..... 343/895, 343/700 MS

See application file for complete search history.

(56) References Cited

U.S. PATENT DOCUMENTS 4,169,267 A * 9/1979 Wong et al. ..... 343/895
6,140,973 A * 10/2000 Annamaa et al. ..... 343/790
6,710,752 B2 * 3/2004 Saito et al. ..... 343/895

* cited by examiner

*Primary Examiner*—Hoang V. Nguyen
(74) *Attorney, Agent, or Firm*—Ladas and Parry LLP

(57) ABSTRACT

An antenna system includes interconnected first, second and third saw-like antenna units, each of which is formed by a plurality of metal strips of specific width. An adjacent two of the first metal strips define a first acute angle therebetween. An adjacent two of the second metal strips define a second acute angle smaller than the first acute angle. An adjacent two of the third metal strips define the third acute angle the same as the first acute angle. The second metal strips of the second antenna unit are located densely in such a manner to provide an electromagnetic induction to achieve a second frequency band different from that provided by the first and third antenna units.

14 Claims, 5 Drawing Sheets

ANTENNA SYSTEM AND A METHOD FOR FABRICATING THE SAME

FIELD OF THE INVENTION

The present invention relates to an antenna system, more particularly to a built-in antenna system for transmitting and receiving signals in first and second frequency bands and the method for fabricating the antenna system.

BACKGROUND OF THE INVENTION

Due to rapid innovation in the electronic communication technology, dual-band antenna system for use in a mobile phone is in the trend. Since the electronic communication apparatus is targeted to be in the compact size, it is the prime object of the manufacturer to produce and design the antenna system with dual bands within the limited space of the apparatus. The design and structure of the antenna system can affect the radiating efficiency and the quality of impedance matching in the feed line.

FIG. 1 shows a conventional antenna system used in a mobile phone. The conventional antenna system includes a helical coil having a plurality of turnings, a diameter D and a pitch distance S between the adjacent two turnings, wherein by making an appropriate adjustment in the diameter D with respect to the pitch distance S. The conventional antenna system is adapted to radiate radio signal in Normal Mode (where $D \ll \lambda$) or Axial Mode (when $\pi \bullet D \geqq \lambda$), in which $\lambda$ denotes the wavelength of the operation frequency. Under the Normal Mode, a conventional wire serves as a Monopole Antenna once the diameter D is substantially equivalent to zero (D=0), the most effective radiating direction is in the plane perpendicular to the axial direction of the conventional wire. In case, the pitch distance S is substantially equivalent to zero (S=0), the conventional antenna system has a loop configuration, generally known as Loop Antenna.

Antenna efficiency and quality are achieved by minimizing resistance losses. Impedance is accumulated within small wire conductors used in the conventional antenna system. It is also noted that a RF connector must be employed in order to integrate the conventional antenna system (whether it has a Helix, Sleeve or Monopole design) within or outside a telecommunication apparatus (such as a mobile phone). Thus, an extra manufacture cost is consequently resulted when fabricating the conventional antenna system thereon.

SUMMARY OF THE INVENTION

The object of the present invention is to provide a built-in antenna system on a printed circuit board for use in a cellular-phone handset, the antenna system has a compact size and a unique structure to provide dual-band capability.

Another object of the present invention is to provide a method for fabricating an antenna system of built-in type which has dual-band capability.

In one aspect of the present invention, an antenna system is provided for transmitting and receiving signals selectively in a first frequency band and a second frequency band, and includes: a first antenna unit including a feeding end of the transceiver, a coupling end opposite to the feeding end and a plurality of interconnected first metal strips between the feeding end and the coupling end, an adjacent two of the first metal strips cooperatively defining a first acute angle therebetween, each of the first metal strips having a first width;

a second antenna unit including a front end coupled electrically to the coupling end of the first antenna unit, a rear end opposite to the front end of the second antenna unit and a plurality of interconnected second metal strips between the front and rear ends, an adjacent to of the second metal strips cooperatively defining a second acute angle therebetween, each of the second metal strips having a second width; and a third antenna unit having a front end coupled electrically to the rear end of the second antenna unit, a rear end opposite to the front end and a plurality of interconnected third metal strips, an adjacent two of the third metal strips cooperatively defining the first acute angle, each of the third metal strips having a third width. The first acute angle is greater than the second acute angle. The second metal strips of the second antenna unit are located densely in such a manner to provide a resonant frequency by virtue of electromagnetic induction to fit the second frequency band.

In a second aspect of the present invention, an antenna system is provided for transmitting and receiving signals selectively in a first frequency band and a second frequency band, and includes: a printed circuit board having opposite upper and lower surfaces; a first saw-like antenna unit including a feeding end and a plurality first metal strips fabricated alternately on the upper and lower surfaces of the printed circuit board, an adjacent two of the first metal strips having a through hole aligned with and connected electrically to each other, each of the first metal strips having a first width; a second saw-like antenna unit connected to the first saw-like antenna unit and including a plurality of second metal strips fabricated alternately on the upper and lower surfaces of the printed circuit board, an adjacent two of the second metal strips having a through hole aligned with and connected electrically to each other, each of the second metal strips having a second width; and a third saw-like antenna unit connected to the second saw-like antenna unit and including a plurality of third metal strips fabricated alternately on the upper and lower surfaces of the printed circuit board, an adjacent two of the third metal strips having a through hole aligned with and connected electrically to each other, each of the third metal strips having a width the same as the first width. An adjacent pair of the through holes in the first and third metal strips on a respective surface of the printed circuit board cooperatively defines a first distance while an adjacent pair of the through holes in the second metal strips on the respective surface of the printed circuit board cooperatively define a second distance shorter than the first distance. The second metal strips of the second saw-like antenna unit are located densely in such a manner to provide an electromagnetic induction to achieve the second frequency band.

In a third aspect of the present invention, a method for fabricating an antenna system is provided to include the steps of: (i) forming first, second and third antenna units on the printed circuit board in such a manner that the first and second antenna units are electrically connected to each other while the second and third antenna units are electrically connected to each other; (ii) adjusting effective lengths of the first and third antenna units, thereby causing the first antenna unit to provide a resonant frequency to fit the second frequency band; and (iii) varying an effective length of the third antenna unit with respective to a constant effective length of the first antenna unit so as to cause the antenna system to provide a resonant frequency to fit the first frequency band.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENTS

The invention disclosed herein is to provide a dual-band antenna system which is fabricated on a printed circuit board and which can transmit and receive a first frequency signal and a second frequency signal simultaneously. The antenna system includes a plurality of tiny metal strips, by varying the widths in the tiny metal strips and the distance of an adjacent two of the through holes (that are used for electrically coupling the tiny metal strips) in the tiny metal strips on a respective side of the circuit board, a minimum return loss is achieved to increase the efficiency and quality of the antenna system. In the following description, two embodiments are set forth in order to provide a thorough understanding of the invention. It will be appreciated by one skilled in the art that variations of these specific details are possible while still achieving the results of the present invention.

Figure 1:
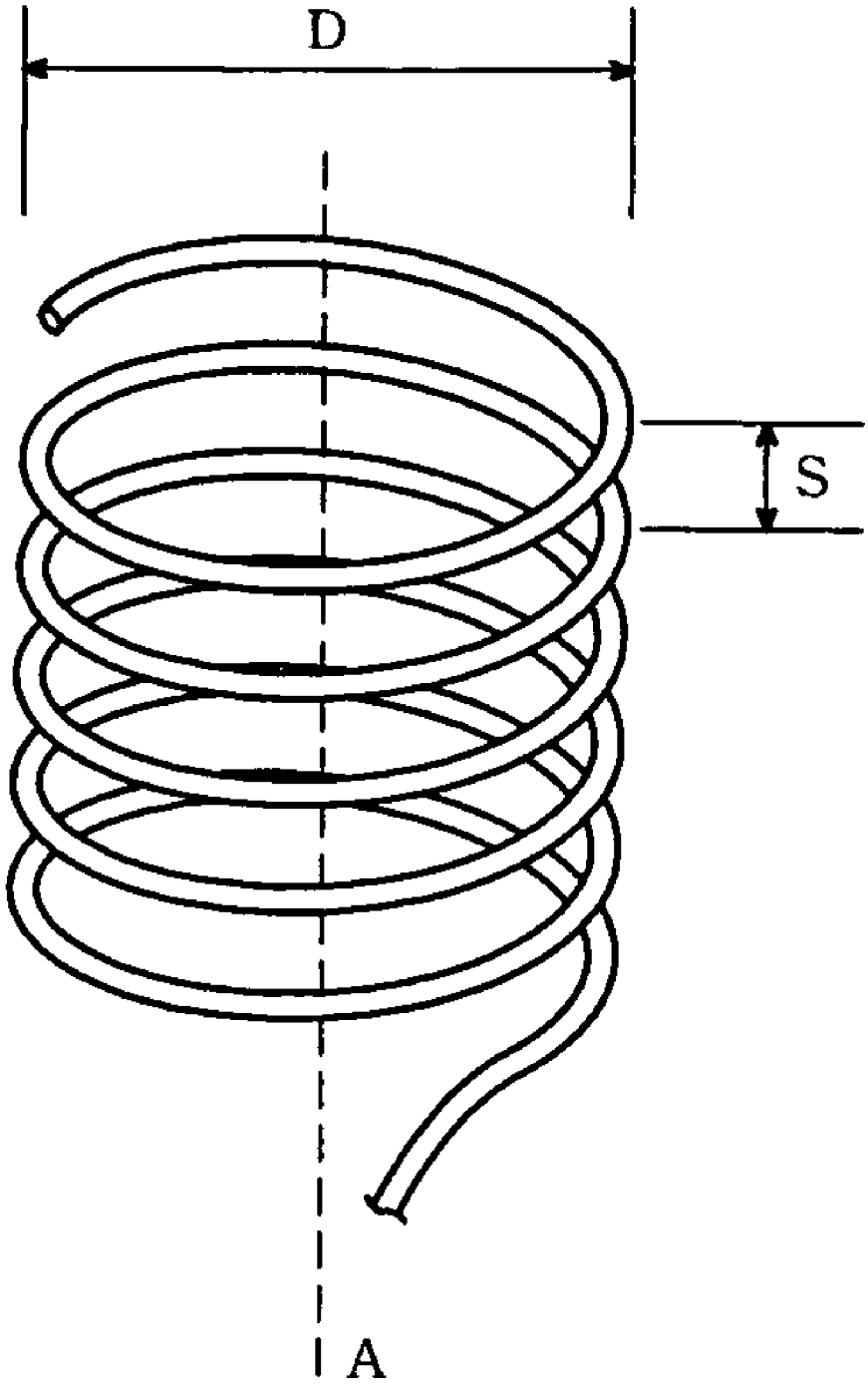
Fig. 1 (Prior Art)
FIG. 1 is a perspective view of a conventional antenna system used in a wireless telecommunication apparatus.
Figure 2:
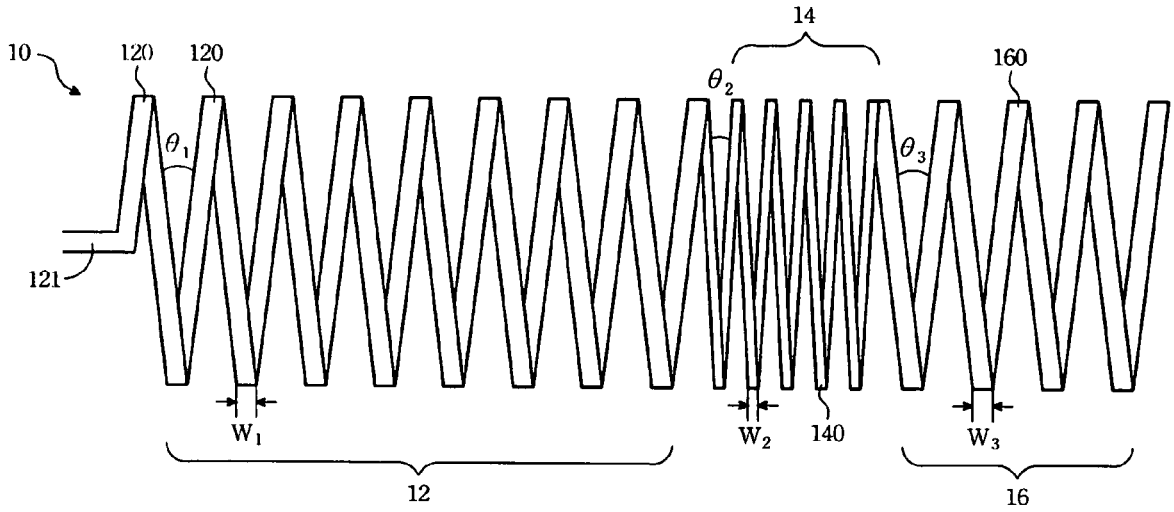
FIG. 2 is a side view of the first embodiment of an antenna system according to the present invention for use in a wireless telecommunication apparatus.

Referring to FIG. 2, a side view of the first embodiment of an antenna system 10 according to the present invention is mounted within an outer casing (not shown) of a wireless telecommunication apparatus (such as a cellular-phone handset), and includes a first antenna unit 12, a second antenna unit 14, and a third antenna unit 16.

The first antenna unit 12 includes a feeding leg 121 for coupling to a transceiver (not shown), and a plurality of interconnected elongated first metal strips 120. Each of the first metal strip 120 has a first width $W_1$. An adjacent pair of the first metal strips 120 cooperatively define a first acute angle $\theta_1$ therebetween. The second antenna unit 14 is coupled electrically to the first antenna unit 12, and includes a plurality of interconnected elongated second metal strips 140. Each second metal strip 140 has a second width $W_2$ shorter than the first width $W_1$ of the respective first metal strip 120. An adjacent pair of the second metal strips 140 cooperatively define second acute angle $\theta_2$ therebetween.

The third antenna unit 16 is coupled electrically to the second antenna unit 14, and includes a plurality of interconnected elongated third metal strips 160. An adjacent pair of the third metal strips 160 cooperatively define a third acute angle $\theta_3$ therebetween that is equivalent to the first acute angle $\theta_1$. Each third metal strip 160 has a third width $W_3$. In this embodiment, the first acute angle $\theta_1$ is greater than the second acute angle $\theta_2$ while the first width $W_1$ of the respective first metal strip 120 is equivalent to the third width $W_3$ of a respective third metal strip 160 and is greater the second width $W_2$ of a respective second metal strip 140. Under this condition, the second metal strips 140 of the second antenna unit 14 are located densely in such a manner to provide an electromagnetic induction to achieve the first frequency band (generally GSM system 880–960 MHz). Besides, the first metal strips 120 provide a resonant frequency to fit the second frequency band (Digital Cellular System mobile-phone handset having 1710–1880 Mhz range and PCS mobile-phone handset having 1850–1990 MHz range).

In the embodiment, the effective length of the current path in each of the metal strips is generally equivalent to a quarter of the intended transmission wavelength. The second metal strips 140 of the second antenna unit 14 are designed to be located densely in such a manner to provide a higher electric field by virtue of electromagnetic induction so as to permit a resonant frequency. For transmitting and receiving signals within a higher frequency range, the resonant effect of the second and third antenna units 14, 16 can be neglected. In addition, the abovementioned metal strips in the first, second and third antenna units can be fabricated on the printed circuit board (not shown) in a perspective manner or a planar configuration, however the structure of the metal strips should cover many other variations encompassed within the spirit of the present invention.

Figure 3:
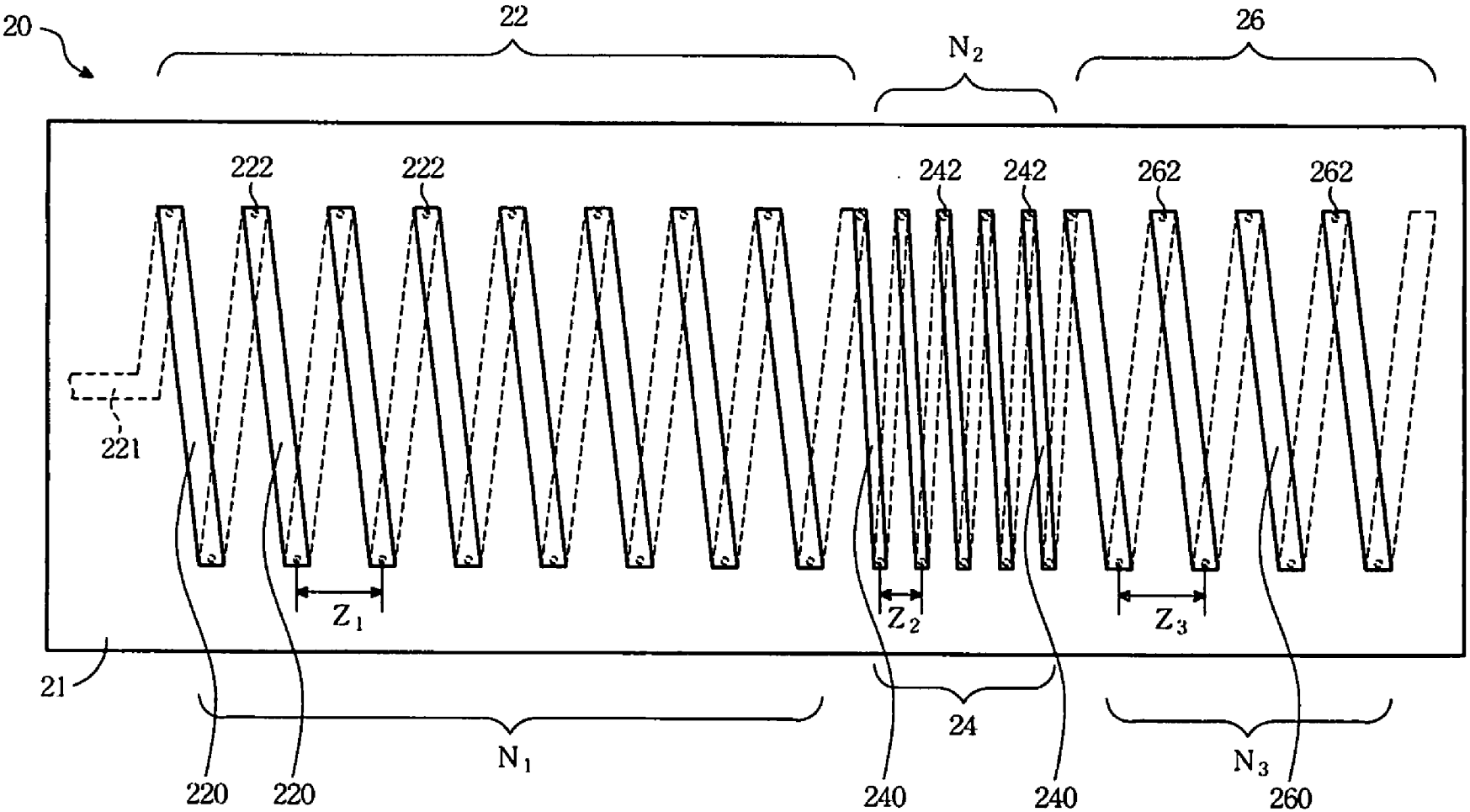
FIG. 3 is a perspective view of the second embodiment of the antenna assembly according to the present invention.

Referring to FIG. 3, a second embodiment of the antenna system 20 according to the present invention is mounted on a printed circuit board 21. The board 21 has opposite upper and lower surfaces. The second embodiment includes a first saw-like antenna unit 22, a second saw-like antenna unit 24, and a third saw-like antenna unit 26. The first saw-like antenna unit 22 includes a plurality first metal strips 220 of a first specific width fabricated alternately on the upper and lower surfaces of the printed circuit board 21. An adjacent two of the first metal strips 220 (one on the upper surface of the board 21, the other on the lower surface of the board 21) have a through hole 222 aligned with and connected electrically to each other. The second saw-like antenna unit 24 is connected to the first saw-like antenna unit 21, and includes a plurality of second metal strips 240 of a second specific width fabricated alternately on the upper and lower surfaces of the printed circuit board 21. An adjacent two of the second metal strips 240 have a through hole 242 aligned with and connected electrically to each other. The third saw-like antenna unit 26 is connected to the second saw-like antenna unit 24, and includes a plurality of third metal strips 260 fabricated alternately on the upper and lower surfaces of the printed circuit board 21. An adjacent two of the third metal strips 260 have a through hole 262 aligned with and connected electrically to each other.

In the second embodiment, the adjacent pair of the through holes 222 in the first and third metal strips 22, 26 on a respective surface of the printed circuit board 21 cooperatively define a first distance $Z_1$ (generally equivalent to $Z_3$) and the adjacent pair of the through holes 242 in the second metal strips 24 on the respective surface of the printed circuit board 21 cooperatively define a second distance $Z_2$ shorter than the first distance $Z_1$. The second metal strips 240 of the second saw-like antenna unit 24 are located densely in such a manner to provide an equivalent electromagnetic induction to isolate the third antenna unit and achieve the second frequency band while the metal strips 220, 260 cooperatively provide a resonant frequency to fit the first frequency band, wherein the second frequency band is higher than the first frequency band.

Figure 4:
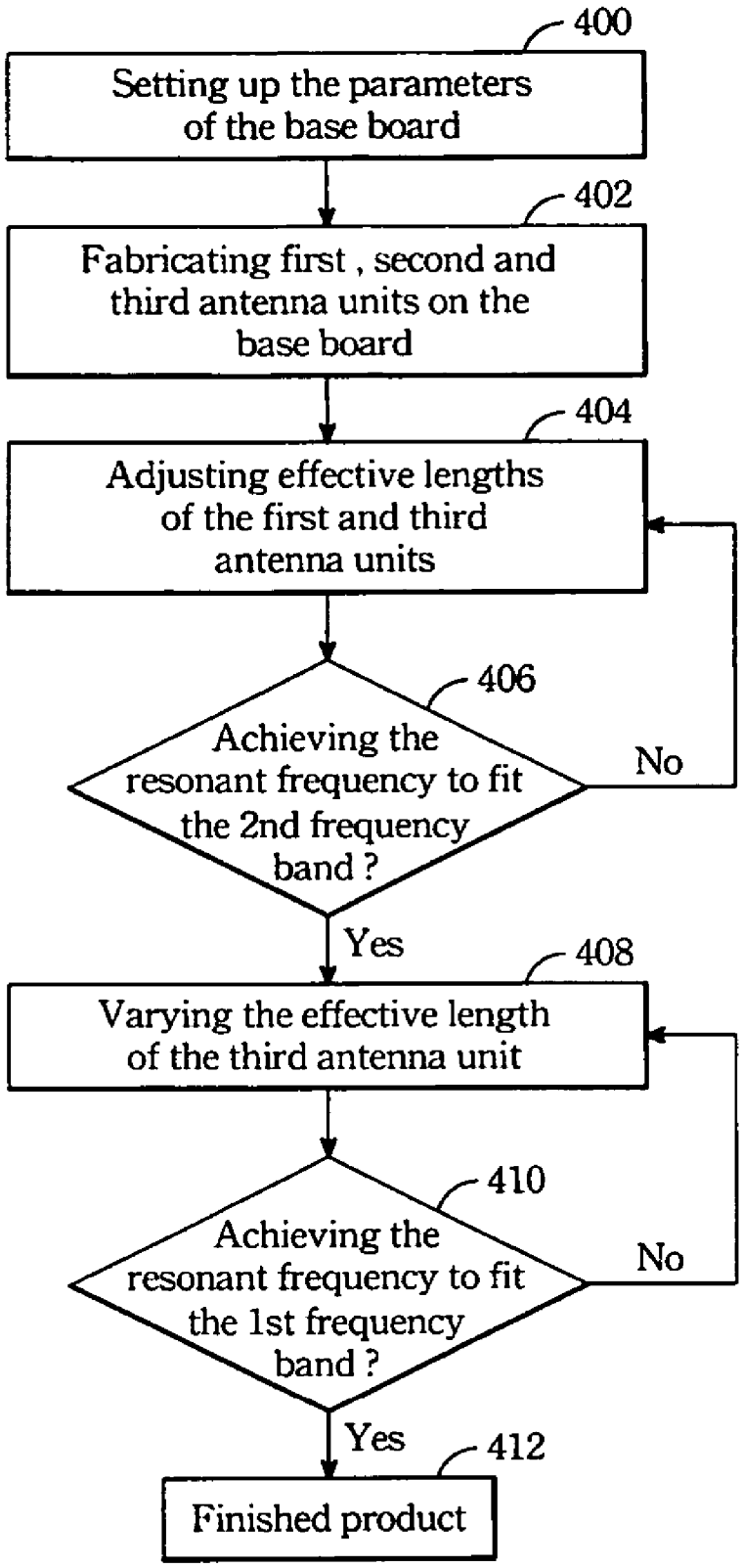
FIG. 4 shows a blocking diagram, illustrating the steps for fabricating the antenna system according to the present invention.

FIG. 4 is a block diagram illustrating the fabricating steps for constructing the antenna system on a printed circuit board according to the present invention. In addition, the fabricating steps are further tested and confirmed by using electromagnetic stimulating software, such as a High Frequency Structure Simulator. The fabricating steps includes the step (400), setting up the parameters of the printed circuit board, i.e., the printed circuit board has a dielectric constant $\in_\gamma$ of 4.4, a thickness of 1.0 mm, and when the medium loss is not taken into account, the printed circuit plate has an axial length of 84 mm, a ground metal layer having a 50 mm in width is the original ground plane. The ground plane has an upper surface defining a domain (16 mm×10 mm) for designing the antenna assembly of the present invention.

According to the step (402), the first, second and third antenna units 22, 24, 26 are mounted on the printed circuit board as shown in FIG. 3, wherein each of the first, second and third antenna units 22, 24, 26 includes a plurality of metal strips which are mounted alternately on the upper and lower surfaces of the printed circuit board. An adjacent two of the metal strips 220,240,260 (one on the upper surface of the board 21, the other on the lower surface of the board 21) have one through hole 222,242,262 aligned with and connected electrically to each other. The step (402) further includes the action of adjusting the width in the respective metal strip, number of turnings in the respective antenna unit, and the distance $Z_1$, $Z_2$, $Z_3$ of the adjacent pair of the through holes 222 in the metal strips 220, 240, 260 on a respective surface of the printed circuit board 21.

Figure 5:
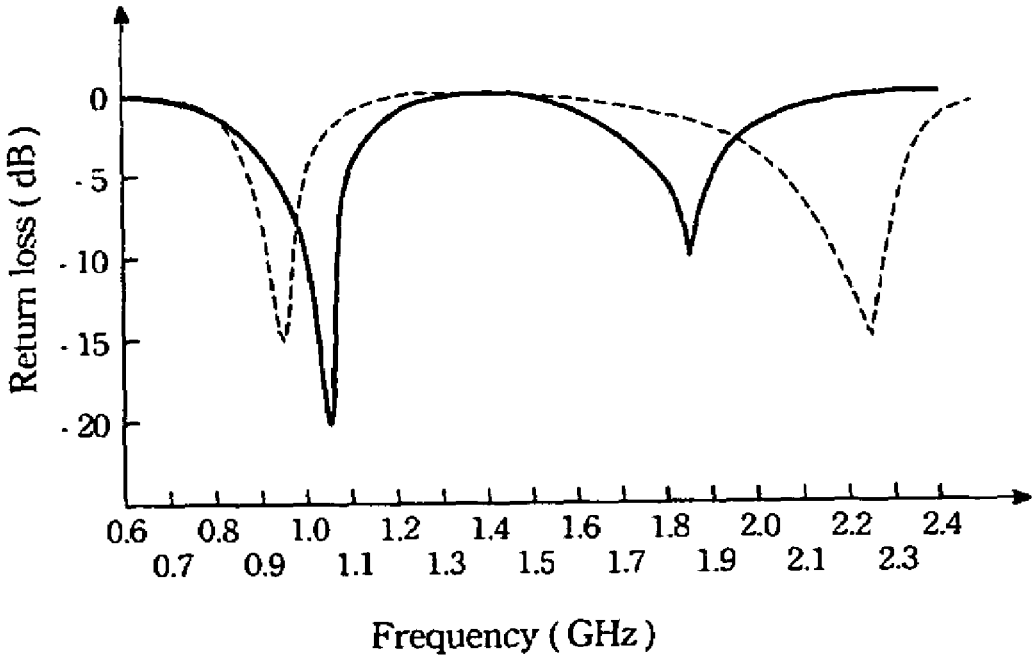
FIG. 5 shows a diagram of computer stimulation result of the modification between the first and third antenna units and its corresponding return loss of the antenna system according to the present invention.

In the embodiment, the transmission and receiving frequency band of the present invention is arranged roughly to center about 900 MHz and 1850 MHz. First of all, setting up respectively the width ($W_1$, $W_2$, $W_3$) and the number of turnings ($N_1$, $N_2$, $N_3$) of the first, second and third metal strips, the distance $Z_1$, $Z_2$, $Z_3$ of adjacent through hole 222,242, 262 in the adjacent metal strips 220,240,260 on the respective surface of the printed circuit board. In case, the width $W_1$=$W_3$=1.0 mm, $W_2$=0.3 mm; the number of turnings $N_1$=5, $N_2$=5, $N_3$=5; the distance of adjacent two through holes $Z_1$=$Z_3$=1.2 mm, $Z_2$=0.4 mm in the front-and-rear direction; the distance of adjacent two through holes is 9 mm in the left-and-right direction, and the diameter $\phi$ of each through hole is 0.25 mm simply. By making appropriate adjustment in the values of $N_1$, $N_2$, $N_3$, and $Z_1$, $Z_2$, $Z_3$ so as to maintain the effective length of the current path at a quarter of the transmission wavelength, the first frequency band (low frequency band) is controlled to be center about 900 MHz. FIG. 5 shows a stimulating diagram, illustrating the different combination of $N_1$ and $N_3$ with respect to the return loss. High Frequency Structure Simulator obtains the diagram after analysis. The dotted lines represent the result when the aforesaid values of the metal strips in the antenna assembly of the present invention are inputted into the High Frequency Structure Simulator, wherein the resonant frequency locate at 925 MHz and 2250 MHz respectively. Note the lower frequency range matches the requirement of the present invention.

According to the step (404), the effective length of the first and third metal strips are adjusted in such a manner to achieve the second resonant frequency. By arranging N1 and N3 of the first and third metal strips at 8 and 2, while maintaining N2 of the second metal strip at 5, the effective length of the first and third metal strips can be achieved. The solid line in the diagram FIG. 5 shows the frequency 1050 MHz and 1875 MHz, which match the second frequency band (the high frequency) (the step 406). In case, the intended resonant frequency of the second metal strips is not achieved, please proceed to the step (404) again until the second metal strips achieve the intended resonant frequency.

Figure 6:
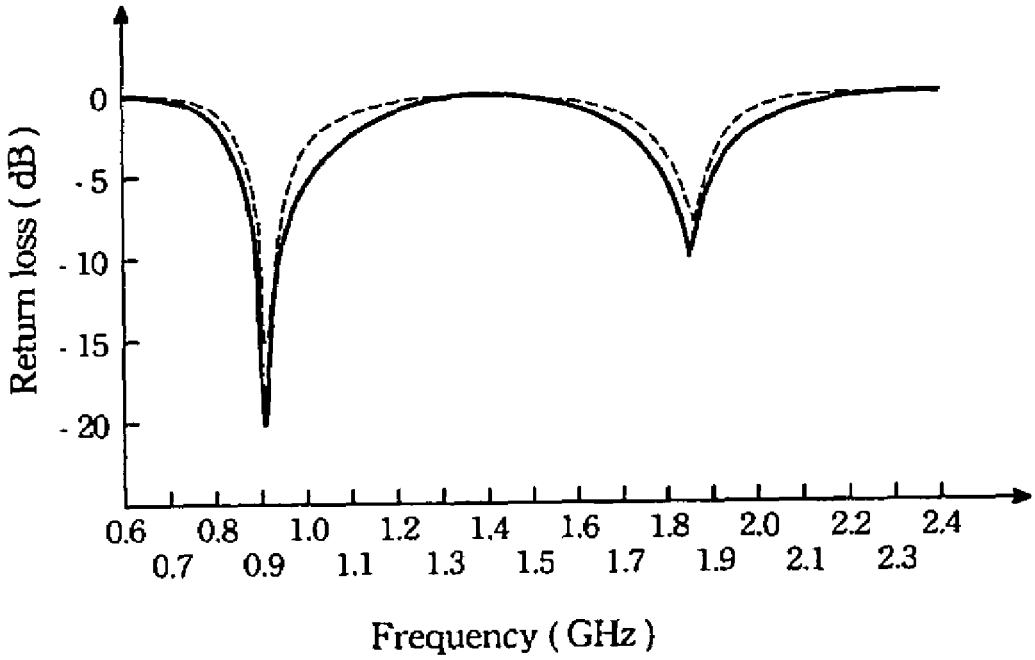
FIG. 6 shows a diagram of computer stimulation result of the different diameter of through hole and its corresponding return loss of the antenna system according to the present invention.

Afterward, adjustment of the effective length of the second metal strip is conducted based on the preset effective length of the first metal strip meanwhile the effective length of the third metal strip is also adjusted in order to achieve the resonant frequency to match the first frequency band (step 408). The effective length of the third metal strip can be obtained by setting the number of turnings N3 to 4. The dotted lines in the diagram FIG. 6 shows the resonant frequency ranging about 925 MHz and 1875 MHz (step 410). From the above diagram one can observe that the lowest and the highest frequency of the resonant frequency are respectively proximate to the first and second frequency bands. In case, the first frequency band is not achieved, please proceed to the step (408) until the former achieve the intended resonant frequency (step 410). Note that according to the step (412) during adjustment of the effective length of the third metal strip, the diameter $\phi$ 0.25 mm of each through hole should be replaced by 0.125 mm so as to achieve the effective length of the third metal strips. The solid lines of the diagram in FIG. 6 show the resonant frequency ranging 913 MHz and 1850 MHz achieved by virtue of the aforesaid adjustment, thereby completing the fabrication of the antenna system of the present invention (step 412).

In short, the antenna system of the present invention provides the following advantages:

(i) Arrangement of the first, second and third metal strips in saw-like configuration, dual-band antenna system can be achieved in the compact size;

(ii) The production cost can be lowered by fabricating the antenna system of the present invention on a printed circuit board so as to increase the production quality;

(iii) Alteration in the dimension of the through hole in the metal strip provides a more freedom during choosing the designs of the antenna system; and (iv) Varying the arrangement of the metal strips on the printed circuit board can alter the dimension of antenna system of the present invention.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An antenna system for transmitting and receiving signals selectively in a first frequency band and a second frequency band, comprising:

a first antenna unit including a feeding leg for coupling to a transceiver, and a plurality of interconnected elongated first metal strips, an adjacent two of said first metal strips cooperatively defining a first acute angle therebetween, each of said first metal strips having a first width;

a second antenna unit coupled electrically to said first antenna unit, and including a plurality of interconnected elongated second metal strips, an adjacent two of said second metal strips cooperatively defining a second acute angle therebetween, each of said second metal strips having a second width; and a third antenna unit coupled electrically to said second antenna unit, and including a plurality of interconnected elongated third metal strips, an adjacent two of said third metal strips cooperatively defining said first acute angle therebetween, each of said third metal strips having a third width;

wherein, said first acute angle is greater than said second acute angle and said second metal strips of said second antenna unit are located densely in such a manner to provide a resonant frequency by virtue of electromagnetic induction to fit the second frequency band.

2. The antenna system according to claim 1, further comprising a printed circuit board, said first and second and third antenna units being fabricated on said printed circuit board.

3. The antenna system according to claim 1, wherein said second width is shorter than said first width and said third width.

4. The antenna system according to claim 1, wherein said second frequency band is higher than said first frequency band.

5. The antenna system according to claim 1, wherein said first width is equivalent to said third width.

6. An antenna system for transmitting and receiving signals selectively in a first frequency band and a second frequency band, comprising:

a printed circuit board having opposite upper and lower surfaces;

a first saw-like antenna unit including a feeding leg and a plurality elongated first metal strips fabricated alternately on said upper and lower surfaces of said printed circuit board, an adjacent two of said first metal strips having a through hole aligned with and connected electrically to each other, each of said first metal strips having a first width;

a second saw-like antenna unit connected to said first saw-like antenna unit, and including a plurality of elongated second metal strips fabricated alternately on said upper and lower surfaces of said printed circuit board, an adjacent two of said second metal strips having a through hole aligned with and connected electrically to each other, each of said second metal strips having a second width;

a third saw-like antenna unit connected to said second saw-like antenna unit, and including a plurality of elongated third metal strips fabricated alternately on said upper and lower surfaces of said printed circuit board, an adjacent two of said third metal strips having a through hole aligned with and connected electrically to each other, each of said third metal strips having a width the same as the first width;

wherein, an adjacent pair of said through holes in said first and third metal strips on a respective surface of said printed circuit board cooperatively defines a first distance and an adjacent pair of said through holes in said second metal strips on the respective surface of said printed circuit board cooperatively define a second distance shorter than said first distance, said second metal strips of said second saw-like antenna unit being located densely in such a manner to provide an electromagnetic induction to achieve the second frequency band.

7. The antenna system according to claim 6, wherein said first width of each of said first metal strips is greater that said second width of each of said second metal strips.

8. The antenna system according to claim 6, wherein said second frequency band is higher than said first frequency band.

9. A method for fabricating an antenna system on a printed circuit board, the antenna system being used for transmitting and receiving signals selectively in a first frequency band and a second frequency band, the fabricating method comprising the steps:

(i) fabricating first, second and third antenna units on the printed circuit board in such a manner that said first and second antenna units are electrically connected to each other while said second and third antenna units are electrically connected to each other;

(ii) adjusting effective lengths of said first and third antenna units, thereby causing said first antenna unit to provide a resonant frequency to fit the second frequency band; and (iii) varying an effective length of said third antenna unit with respective to a constant effective length of said first antenna unit so as to cause the antenna system to provide a resonant frequency to fit the first frequency band.

10. The method according to claim 9, wherein the printed circuit board has opposite upper and lower surfaces, said first antenna unit including a feed leg and a plurality first metal strips fabricated alternately on said upper and lower surfaces of said printed circuit board, an adjacent two of said first metal strips having a through hole aligned with and connected electrically to each other, each of said first metal strips having a first width.

11. The method according to claim 10, wherein the adjusting effective length of said first antenna unit of the step (ii) further includes alteration in the diameter of said through hole in each of said first metal strips.

12. The method according to claim 9, wherein the printed circuit board has opposite upper and lower surfaces, said second antenna unit including a plurality of second metal strips fabricated alternately on said upper and lower surfaces of said printed circuit board, an adjacent two of said second metal strips having a through hole aligned with and connected electrically to each other, each of said second metal strips having a second width.

13. The method according to claim 9, wherein the printed circuit board has opposite upper and lower surfaces, said third antenna unit including a plurality of third metal strips fabricated alternately on said upper and lower surfaces of said printed circuit board, an adjacent two of said third metal strips having a through hole aligned with and connected electrically to each other, each of said third metal strips having a width the same as the first width.

14. The method according to claim 13, wherein the variation of effective length of said third antenna unit in the step (iii) includes alteration in the diameter of said through hole in each of said third metal strips.

* * * * *